United States Patent [19]

Turner et al.

[11] Patent Number: 4,460,218

[45] Date of Patent: Jul. 17, 1984

[54] CHARACTERIZATION OF IN SITU OIL SHALE RETORTS PRIOR TO IGNITION

[75] Inventors: Thomas F. Turner; Dennis F. Moore, both of Laramie, Wyo.

[73] Assignee: The United States of America as represented by the United States Department of Energy, Washington, D.C.

[21] Appl. No.: 385,206

[22] Filed: Jun. 4, 1982

[51] Int. Cl.[3] ..... E21C 41/10; E21B 47/10

[52] U.S. Cl. ..... 299/1; 299/2; 166/251

[58] Field of Search ..... 436/27; 324/338; 166/250, 251, 259; 73/151, 152, 432 R; 299/2, 11, 1

[56] References Cited

U.S. PATENT DOCUMENTS

| | | | |
|---|---|---|---|
| 4,119,345 | 10/1978 | Bartel et al. | 299/2 |
| 4,199,026 | 4/1980 | McCollum | 166/251 |
| 4,249,602 | 2/1981 | Bunton et al. | 166/251 |
| 4,266,608 | 5/1981 | McCollum | 166/250 |
| 4,279,302 | 7/1981 | Cha | 166/251 |

OTHER PUBLICATIONS

Loucks, Robert A., *Occidental Vertical Modified In Situ Process for the Recovery of Oil from Oil Shale: Phase 1,* U.S. Dept. of Energy, Nov. 1977, pp. 8–10.

*Survey of E.M. and Seismic Noise Related to Mine Rescue Communications,* vol. I, Arthur D. little Inc., Jan. 1974.

Holmes and Balanis, *E.M. Wave Propagation Within a Subsurface Coal Seam for In Situ Gasification Application,* 1977.

*Quarterly Progress Report Oct. 1980–Mar. 1981,* Laramie Energy Research Center, Feb. 1982, pp. 25–26.

*Primary Examiner*—Gerald Goldberg

*Assistant Examiner*—E. G. Harding

*Attorney, Agent, or Firm*—Clifton E. Clouse, Jr.; Roger S. Gaither

[57] ABSTRACT

Method and system for characterizing a vertical modified in situ oil shale retort prior to ignition of the retort. The retort is formed by mining a void at the bottom of a proposed retort in an oil shale deposit. The deposit is then sequentially blasted into the void to form a plurality of layers of rubble. A plurality of units each including a tracer gas cannister are installed at the upper level of each rubble layer prior to blasting to form the next layer. Each of the units includes a receiver that is responsive to a coded electromagnetic (EM) signal to release gas from the associated cannister into the rubble. Coded EM signals are transmitted to the receivers to selectively release gas from the cannisters. The released gas flows through the retort to an outlet line connected to the floor of the retort. The time of arrival of the gas at a detector unit in the outlet line relative to the time of release of gas from the cannisters is monitored. This information enables the retort to be characterized prior to ignition.

17 Claims, 9 Drawing Figures

CHARACTERIZATION OF IN SITU OIL SHALE RETORTS PRIOR TO IGNITION

BACKGROUND OF THE INVENTION

The present invention relates to methods and systems for characterizing in situ oil shale retorts, and more particularly it relates to detailed characterization of commercial scale retorts prior to ignition and burning of such retorts.

There are various schemes used in the art for characterizing an in situ retort. These schemes relate to characterization during burning and characterization prior to burning that are unsuitable for commercial scale retorting. The schemes for characterization during burning include one disclosed in U.S. Pat. No. 4,249,602, to Burton et al., issued Feb. 10, 1981, and hereby incorporated herein by reference, wherein tanks filled with a halogen are buried in the rubble of a retort. The tanks are thermally responsive to release the halogen when the processing zone reaches each tank. The off gas is analyzed to determine the locus of the processing zone as it advances through the rubble.

In another scheme for characterization during burning, as disclosed in U.S. Pat. Nos. 4,266,608, to McCollum, issued May 12, 1981, and 4,199,026 to McCollum, issued Apr. 22, 1980 (both hereby incorporated herein by reference), sensing devices each with an associated rf transmitter are buried in the rubble of a retort. During burning of the retort the various devices may be activated by means of signals transmitted from the surface or they may be operated continuously to provide rf information to the surface concerning the physical and chemical properties of the surroundings of each device.

In still another scheme for characterization during burning, as disclosed in U.S. Pat. No. 4,279, 302 to Cha, issued July 21, 1981, and hereby incorporated herein by reference, the locus of the processing zone is determined by monitoring the heating value of the effluent gas which is a function of the kerogen content of the oil shale being burned at a particular time. The heating values are correlated with actual kerogen content of the oil shale rubble which is assayed for kerogen content at selected locations in the retort before processing begins.

In the schemes for characterizing a retort prior to processing, one is disclosed in U.S. Pat. No. 4,119,345, issued to Bartel et al. on Oct. 10, 1978, and hereby incorporated herein by reference, wherein the pressure drop of a measuring gas introduced at the top of the retort is measured at a location intermediate to the top and bottom of the retort. Access to the intermediate location is by means of a lateral drift. Then the pressure drop of a measuring gas introduced at the intermediate level is measured between the intermediate level and the bottom of the retort. These measurements provide a gross characterization of the retort to enable the rubble to be burned advantageously selectively. However, a drift is required for each level at which a measurement is to be made.

In another scheme for characterizing a retort in more detail, such as disclosed on pages 8–10 in *Occidental Vertical Modified In Situ Process: Phase I,* Vol. 1, Summary Report Nov. 1, 1976–Oct. 31, 1977, U.S. Dept. of Energy technical report No. TID-28053, Nov. 1977, hereby incorporated herein by reference, existing blast holes from the surface to the top of the retort are each injected with a different tracer gas. Then the concentration of the different gases is recorded with respect to time at the outlet at the bottom of the retort. This information provides a degree of detail useful for characterizing the retort.

Although the foregoing schemes provide characterization of in situ retorts before and during a burn, there exists a need for a more detailed characterization of such retorts prior to a burn to ensure successful commercial large scale operation. However, it is also required, because of the large scale and number of retorts that such characterization be accomplished by a means and method that is economically practical. In particular, the Vertical Modified In Situ (VMIS) method of retorting oil shale is suitable for a commercial scale operation. This method requires mining a void, then blasting into the void to form a chimney of unretorted shale rubble. After blasting, the rubble is ignited at the top; air flow is established from top to bottom; and the burn front moves downward, retorting the oil shale in front of it. Shale oil product is collected at the bottom of the retort and pumped to storage. A schematic diagram of a retort formed by the VMIS method and depicted at mid-stage processing is shown in FIG. 1. In this process a vertical column 15 of rubbled oil shale is ignited at the top and then retorted from the top of the column to the bottom by pumping air down access holes 16. The products formed by the process are withdrawn at an outlet 18 at the bottom of the retort.

One of the problems encountered during retorting using the VMIS method as well as other methods is flame front channeling resulting in the burning, coking or by-passing of potential product. Channeling is caused by nonuniformities in flow which are in turn caused by local differences in the particle size distribution and void fraction. If the flow properties of the retort are known in advance, channeling often can be reduced or eliminated by modifying retorting strategy. The most common method used to measure airflow distribution is gas tracer testing. This entails injecting a small amount of easily detectable tracer gas into the air inlet or into the top of the rubble zone and monitoring its concentration at sampling points farther down the retort. Typically the injection is a narrow concentration pulse of gas and the data output at any sampling point is a significantly wider pulse. The time of arrival of a pulse is used to calculate air flow velocity and, in some cases, the active void of the retort. The pulse shape can indicate the amount of dispersion, dead volume and mass flow depending on how much is already known about the rubble.

In the past, as discussed previously herein, intermediate level access drifts and sampling ports have been used to monitor tracer concentration during tracer tests such as in the U.S. Pat. No. 4,119,345. Such intermediate level sampling can provide detailed information of flow velocities in the mid region of a retort. However, in commercialized VMIS technology, economic constraints will limit the amount and type of instrumentation in each retort. Thermocouple and gas sampling ports at intermediate levels of the retorts are expensive and will be reduced in number or eliminated, leaving only sampling at the outlet of a retort. This severely limits the degree to which a rubble chimney can be characterized. Since the intermediate level access is economically impractical, there is insufficiently detailed data available to make major retorting strategy changes with confidence. New technology is needed that provides economical and simple methods of determining the gas flow characteristics of individual retorts.

In one particular method of in situ retorting, a void is first mined at the bottom of the planned retort and then overlying layers of oil shale rock are sequentially blasted into the void. This sequential rubbling method allows the use of a new type of instrumentation. One of the new types is a cannister such as disclosed in the U.S. Pat. No. 4,249,602, discussed hereinbefore, developed at Lawrence Livermore National Laboratory (LLNL). The cannister releases a tracer gas when it reaches a predetermined temperature. The cannister may easily be placed into the retort between detonations of the blasting sequence through holes previously drilled for blasting. The location of each cannister is determined by the rubbled shale level and the horizontal coordinates of the blast hole. During retorting the outlet gas flow from the retort is continuously monitored and the time of arrival of each tracer gas is recorded. The times of arrival of tracers from many cannisters are then used to map the temperature front in the retort. This is a valuable technique, but it cannot be used to interrogate and then characterize a cold rubbled zone before ignition.

SUMMARY OF THE INVENTION

It is an object of the invention to characterize a rubbled in situ retort in detail prior to ignition of the rubble.

Another object is to provide a method and system that is economically practical for effectively characterizing rubbled in situ retorts prior to ignition of the rubble.

Another object is to characterize a commercial scale vertical modified in situ retort prior to ignition of the retort.

In brief the invention is a method, and a system for practicing the method, for characterizing an in situ oil shale retort prior to ignition of the retort, wherein the retort is formed by mining a void having a floor in an oil shale deposit, and then sequentially blasting a plurality of layers of rock rubble into the void, each of the layers having an upper level, a roof being formed in the retort by the last sequence of the blasting, the retort being provided with a plurality of access holes from the surface of the earth to the roof, and an outlet at the floor of the retort, including the steps of: installing a plurality of units containing tracer gas at the upper level of each layer of rubble prior to blasting to form the next layer, each of the units including receiving means that is responsive to a coded electromagnetic (EM) signal to release gas into the rubble; transmitting coded EM signals to the receiving means to selectively release gas from the units; forcing the released gas to flow to the outlet; and monitoring the time of arrival of the released gas for characterization of the retort.

Other objects and advantages of the invention will be apparent in a description of a specific embodiment thereof, given by way of example only, to enable one skilled in the art to readily practice the invention which is described hereinafter with reference to the accompanying drawing.

DESCRIPTION OF THE PREFERRED EMBODIMENT

Figure 1:
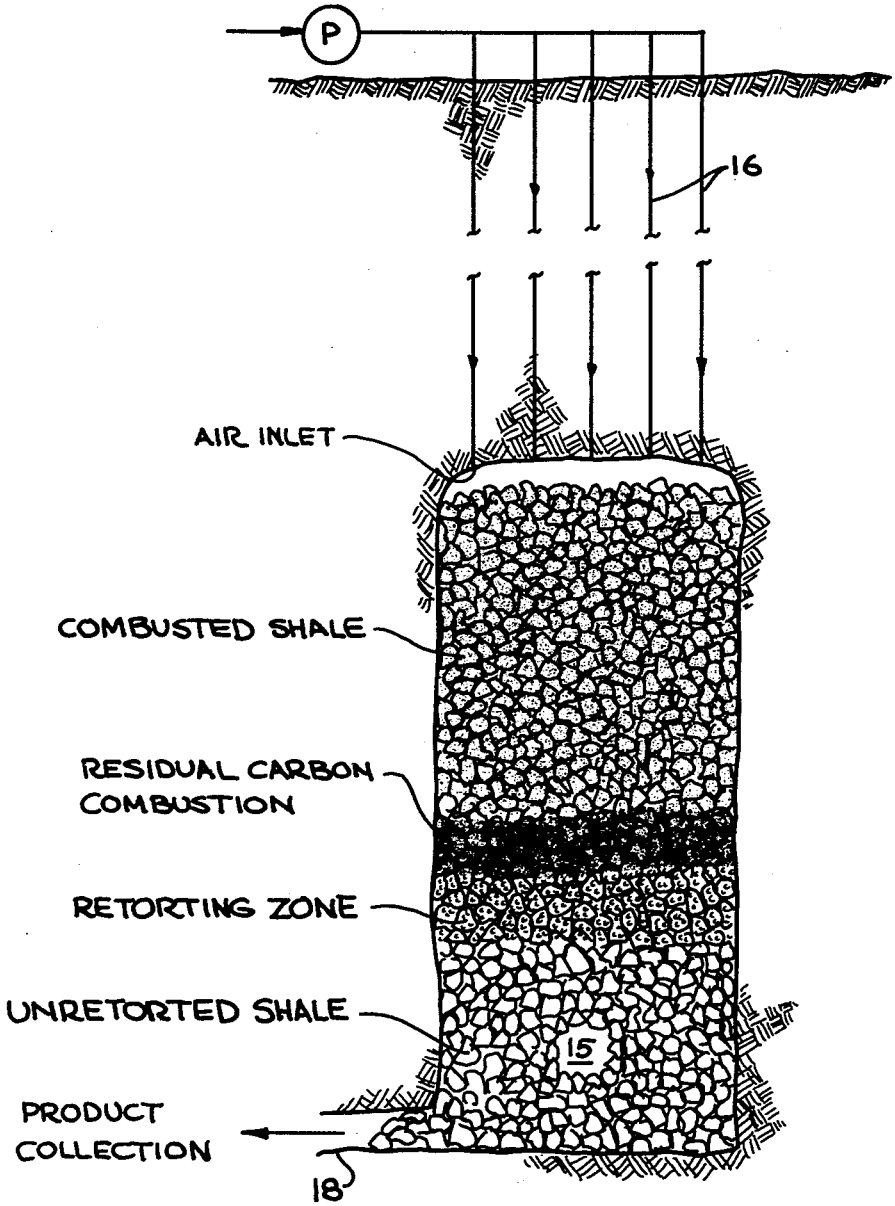
FIG. 1 (PRIOR ART)
FIG. 1 is a schematic diagram of a retort formed by a VMIS method and depicted at mid-stage processing, according to the prior art.

Referring to the drawing, there is shown in FIG. 1 a schematic diagram of a prior art retort 15 comprising a column of rubbled oil shale formed by a vertical modified in situ (VMIS) method and depicted at mid-stage processing. In this process the rubble is ignited at the top of the column and air is pumped down through access holes 16 to the column to force a burn from the top of the column to the bottom, with the products formed by the process being withdrawn at the bottom of the column at an outlet 18.

In order to ensure a successful burn in a VMIS retort it has been found desirable to characterize the retort prior to ignition. Instrument drifts may be mined or gas sampling ports may be drilled to obtain information for such characterization. However, these procedures are relatively expensive and become prohibitively expensive for large scale commercial operation where many retorts are to be created in a formation. The present invention is a method and system that is practical and economical and particularly useful for characterizing a VMIS retort formed by sequential rubbling.

Figure 2:
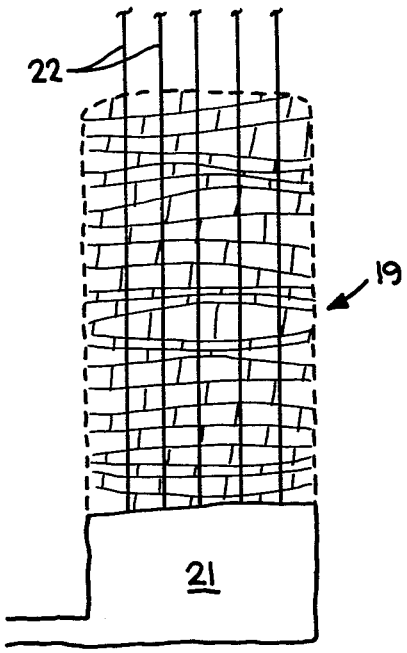
FIG. 2 (PRIOR ART)
FIG. 2 is a schematic diagram of an initial stage in the formation of a retort by a particular VMIS method wherein a void is mined at the bottom of the retort and then successive layers of shale are sequentially blasted into the void.

Referring to FIG. 2, a retort 19 is shown in an initial stage of formation wherein a void 21 is first mined in the formation at the bottom of the proposed retort. The dotted outline of the retort 19 indicates the shale to be blasted into the void.

Figure 3:
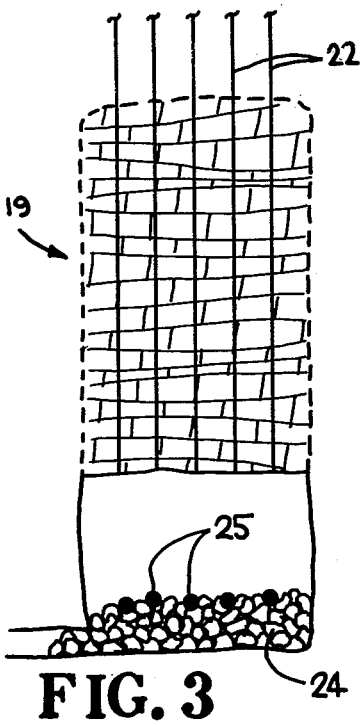
FIG. 3 is a schematic diagram of the retort of FIG. 2 with EM receiver units containing tracer gas cannisters emplaced at the top of the rubble produced by the first blast of the sequence, according to the invention.

Blast holes 22 are drilled through the formation to the void. The lower ends of these holes are then loaded with explosives to an extent that will provide partial rubbling into the void 21. The explosive is then blasted. The resulting fractured rock falls into the void as shown in FIG. 3 to form a pile of rubble 24.

In accordance with the invention, a first set of tracer gas release units 25, more fully described hereinafter, are lowered down the blast holes 22 and emplaced at a first level on the top of the rubble pile 24. It should be noted that the units 25 are usually located in a substantially horizontal plane on each level rather than the single row shown in the Figures.

Figure 4:
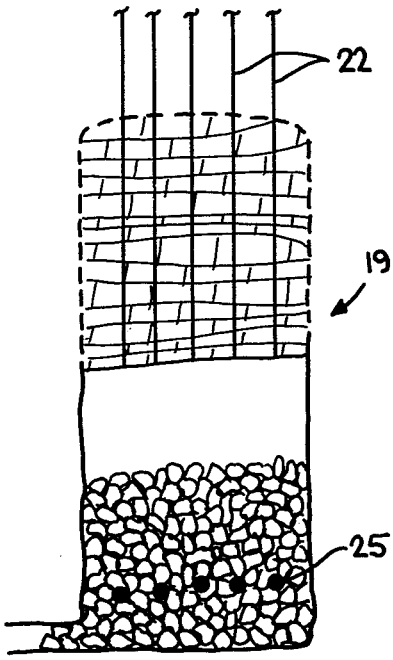
FIG. 4 is a schematic diagram of the retort of FIG. 2 after the second blast of the sequence which covers with rubble the gas units emplaced after the first blast.
Figure 5:
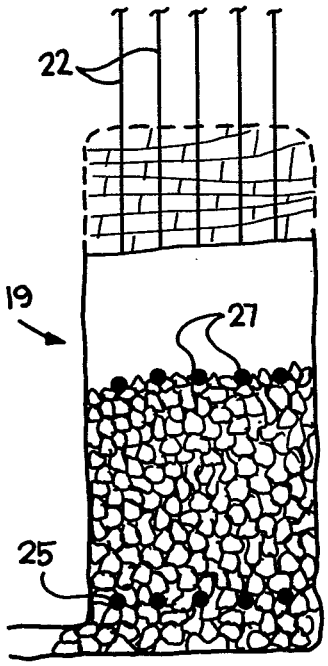
FIG. 5 is a schematic diagram of the retort of FIG. 2 with a second layer of tracer gas units emplaced at the top of the rubble over the first layer of cannisters.
Figure 6:
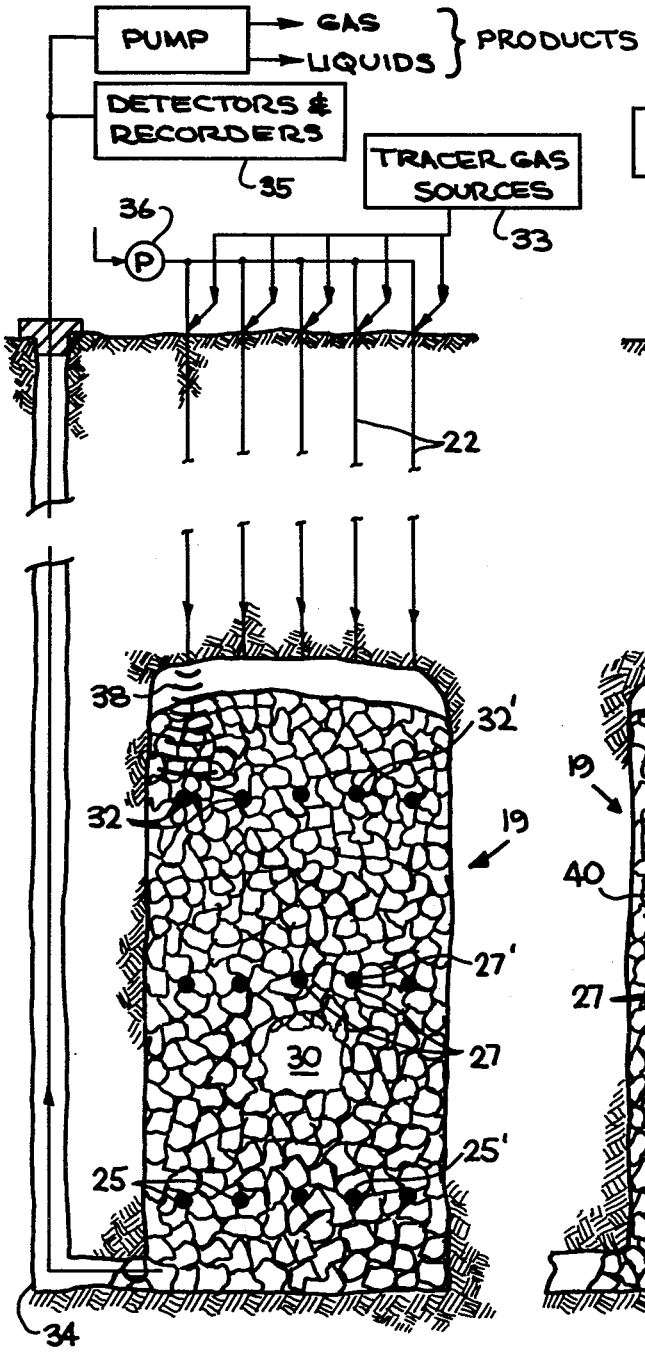
FIG. 6 is a schematic diagram of the completed retort of FIG. 2 with tracer gas units emplaced at three levels intermediate the top and bottom of the retort.

Next, the new lower ends of the blast holes 22 are loaded with explosives to an extent that will provide partial rubbling into the void to cover the emplaced tracer gas release units 25 as shown in FIG. 4. After this or more blasts, the rubble pile is increased to a higher level such as shown in FIG. 5. A second set of tracer gas release units 27 are then lowered down the blast holes 22 and emplaced at a second level on the top of the new rubble pile. Additional blasting in the manner described is carried out to complete the retort to form a column 30 (FIG. 6) of rubbled shale. Additional tracer gas release units are emplaced between rubble layers to the extent appropriate to the size of the completed retort. For convenience of depiction, only one additional set of units 32 are shown in FIG. 6 emplaced at a third level.

Prior to ignition of the column 30, the retort is characterized in several steps. An example of a particular series of steps may be as follows. First a different tracer gas is injected sequentially down each of the holes 22, such as indicated by air-gas flow 38, by selectively injecting different gases from tracer gas sources 33. Each different gas is mixed with air by means of a pump 36 and pumped down the column 30 to an outlet line 34 at the bottom of the column 30. A set of tracer gas detectors and recorders 35 are connected to the outlet line 34 to detect and record and thereby monitor the concentration of each of the different tracer gases with respect to time after injection of the gases.

The next steps are to sequentially activate a set of tracer gas units at a particular level and then proceed to activate the units at another level. It is convenient to sequentially activate the units 32 on the upper level first, as inicated by a gas flow 40, and then proceed downward to the units 27 and 25. Each of the units on any one level contains a different gas that is forced downward individually upon release, with air injected by the pump 36. It is convenient, however, that vertically aligned units 25', 27' and 32' will contain the same gas. The detector and recorders 35 are used for each level to determine the concentration of each of the different tracer gases with respect to time after release of the gas. With this information the residence times for the gases in incremental volumes of the retort height may be found by subtraction of successive data sets recorded for the same gas injected at successively lower levels of the retort. The shape of each pulse of tracer gas as it emerges from the outlet line 34 may be used to calculate dispersion and thereby determine dead volume. From the foregoing determinations, the retort 19 may be characterized prior to ignition to determine how the burn should be run to maximize the products or whether it would be profitable to burn at all.

The tracer gas release method and system of the present invention provides information similar to a system using gas sampling ports, but has the advantage of not needing any additional mining for placement of instrumentation. The units 25, 27 and 32, conveniently may be emplaced during the survey of the top of the rubble after each blast. A down-hole TV system lowered through the holes 22 normally is used for such a survey, and to measure particle size, and to inspect the walls of the blast holes. The addition of a latch mechanism to the bottom of the camera allows placement and inspection of each remotely activated tracer gas release unit, and yet allows the normal surveying operation to proceed unchanged. After the units have been emplaced and the TV survey completed, each unit can be buried in gravel to help distribute the impact from later rubbling.

Figure 7:
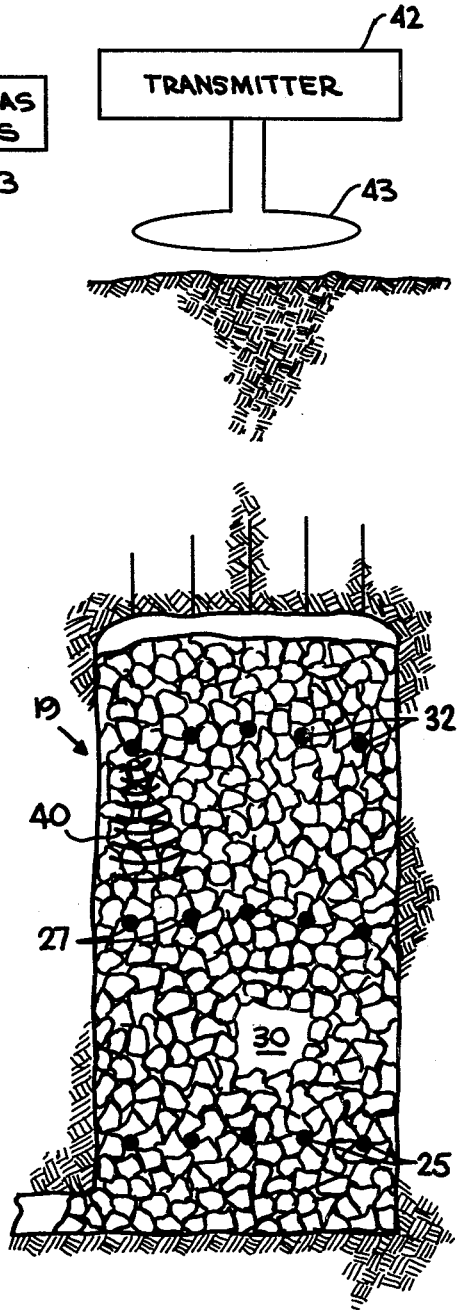
FIG. 7 is a schematic diagram of the completed retort of FIG. 2 with the emplanted gas units being sequentially activated by EM signals transmitted from the surface.

An important element in the system and method of the present invention is the remote activation and release of tracer gas from each unit in proper predetermined sequence and at the proper time. This is accomplished by generating a signal in a transmitter 42 (FIG. 7) for application to a loop antenna 43 that is positioned on the ground surface over the retort 19. Each of the units 25, 27 and 32, is provided with a receiver that is battery operated. Each receiver may be activated in response to a uniquely coded signal from the transmitter 42 to release tracer gas from the associated unit. The transmitted signals are modulated, preferably by frequency shift keying (FSK), so that the corresponding subsurface units can be activated individually at selected times by using different modulation codes. All of the subsurface receivers may be tuned to the same center frequency. Power frequency harmonics or interfering signals have a low probability of activating the units because these sources of interference are not appropriately coded.

The transmitter 42 was designed to be modulated by frequency shift keying (FSK) using the two frequencies 3030 Hz and 3150 Hz. These frequencies were selected as a compromise between minimal underground EM signal attenuation and minimal interference from underground electromagnetic noise. Electromagnetic noise in underground coal mines has been investigated and the results summarized in a report by Arthur D. Little Incorporated, *Survey of Electromagnetic and Seismic Noise Related to Mine Rescue Communications,* Volume I, PB-235069, January 1974, hereby incorporated herein by reference. A curve showing attenuation of the vertical magnetic field component as a function of distance is found in FIG. 2-1 of this report. Equations for electric and magnetic field strength in a lossy medium are given by Holmes and Balanis in *Electromagnetic Wave Propagation Within A subsurface Coal Seam for In Situ Gasification Application,* Progress Report May 1, 1976–Apr. 30, 1977, ORO-5081-12, ERDA, 1977, hereby incorporated herein by reference.

The electromagnetic noise data for underground coal mines was readily available and presented a worst case situation. Electromagnetic noise for oil shale retorts is expected to be considerably less than for coal mines. In general, with a reduction or increase in EM noise and changes in absorption losses specific to particular formations and sites, the choice of specific frequencies should be, as mentioned before, a compromise between signal attenuation and noise. The frequencies to be used may be in the range of very low frequency (VLF) signals (3,000–30,000 Hz) down to and including voice frequency (VF) signals (300–3,000 Hz), the preferable range being 300–6,000 Hz.

Frequency shift keying enables reception in which discrimination between a correct signal and interferring signals is greater than for amplitude shift keying. Furthermore, for FSK the same demodulation threshold is optimum for any input signal-to-noise ratio.

The signals generated in transmitter 42 may be modulated according to a standard binary code such as the American Standard Code for Information Interchange (ASCII). This would provide a relatively large number of possible codes. However, for a system in which only a small number of codes are required, a simpler coding scheme may be implemented wherein a square wave having a different frequency for each code is used to FSK modulate the transmitter 42. The receiver in each of the subsurface units 25, 27 and 32 can be activated by only one of the frequency codes. This simplified code can be decoded at less cost than would be required to decode ASCII.

Figure 8:
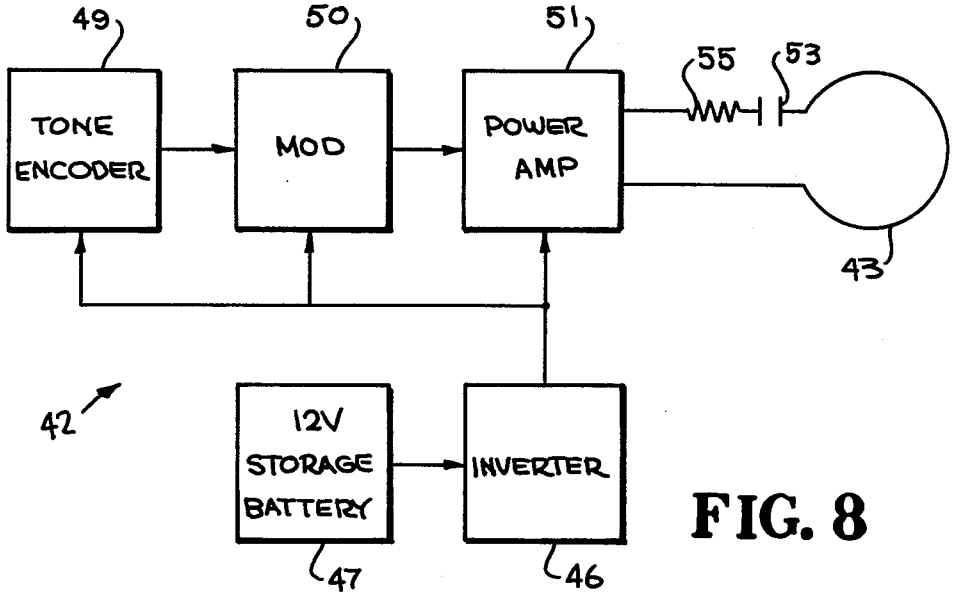
FIG. 8 is a block diagram of a transmitter for activating the tracer gas units to release tracer gas as indicated in FIG. 7.

A block diagram of the transmitting unit 42 is shown in FIG. 8. In an actual embodiment, the unit is powered by an inverter 46 connected to a 12 volt storage battery 47. A tone encoder 49 is controlled to generate a square wave having the coded frequency which is selectively applied to a modulator 50 to shift key a sinewave carrier between 3030 Hz and 3150 Hz. The FSK signal from the modulator is amplified in a power amplifier 51 to produce a current i(t) of several amperes in the transmitting loop antenna 43. A long circular loop of wire is placed on the ground surface to form the transmitting loop antenna 43. A field test (to be described later) was conducted using a loop antenna having a diameter of approximately 44 m. A capacitor 53 is used to series resonate the loop antenna. A resistor 55 is added to increase the bandwidth of the transmitter to minimize frequency distortion of the transmitted signal and to also provide a convenient impedance to use in measuring the loop current.

Figure 9:
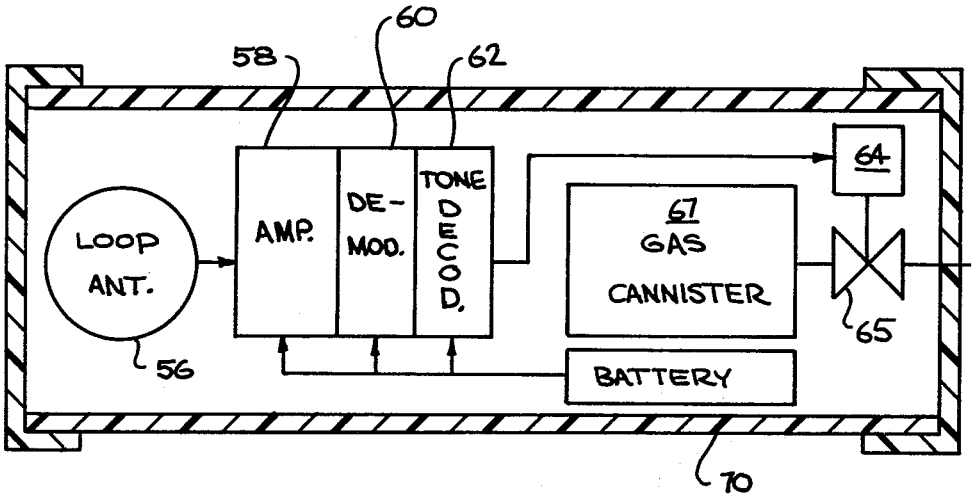
FIG. 9 is a block diagram of a receiver unit packaged with a gas cannister for releasing tracer gas from the cannister upon receiving a signal from the transmitter of FIG. 8.

A block diagram of the units 25, 27 and 32 is shown in FIG. 9. In an actual embodiment, each unit is powered by a battery pack such as one consisting of Alkaline-Manganese Dioxide, size D, 1.5 volt cells which may be conventional size D alkaline flashlight batteries. A voltage v(t) induced in a receiving loop antenna 56 by the transmitter 42 is amplified and filtered by an amplifier 58 which includes a preamplifier and a hard-limited output amplifier. The amplifier 58 has a gain of 72 dB and 3 dB bandwidth of 166 Hz centered at 3090 Hz. The hard-limited output provides a 0.5 volt squarewave that carries the FSK modulation which is applied to a demodulator 60. The demodulator output contains the frequency code that was selected for transmission and is applied to a tone decoder 62. If the tone decoder is tuned to the frequency code that was transmitted, a signal is applied to a solenoid 64 which opens a valve 65 to release a tracer gas from a cannister 67. The valve is latched open to insure that the cannister completely empties. The system was designed for a 300 cc canister to be filled to a maximum pressure of $1.03 \times 10^4$ KPa (1500 psi).

Each of the units 25, 27 and 32 may be packaged in an electrical insulating material such as a plastic (PVC) pipe 70 and then filled with foam to provide rigidity and cushion. The electronics should be in boxes that are sealed to prevent the intrusion of moisture.

The receiver was found to have more than adequate sensitivity and interference rejection. The receiver did not respond to false signals such as power frequency harmonics or to a strong carrier or even to the presence of two strong carriers regardless of their frequency separation. This rejection of two false carriers is effected by using FSK and hard-limiting.

A transmitter and receiver, according to the invention, were field tested using the Occidental Oil Shale Inc. mine at Logan Wash which is approximately 56 km (35 miles) northeast of Grand Junction, Colo. The transmitter was located on the surface above the mine. The current in the transmitting loop antenna was adjusted to 2.0 A RMS. The plane of the loop dipped approximately 6° with the up dip end to the north. For this field test a single turn of RG-59U coaxial cable was used. The shield of this cable was used as the conductor in order to minimize the resistance and inductance of the loop.

The receiver was taken into the upper level of the mine which is 221 meters below the surface. A light bulb was substituted for the tracer gas release solenoid to provide visual indication of signal detection. A true RMS meter was used to measure signal and noise levels. The receiver was hand carried throughout a section of the mine to determine the usable coverage area. The signal was reliably detected within at least a 100 m radius circle centered directly below the center of the transmitting loop. To the north and northeast the radius was at least 122 m. With the transmitter turned off, the electromagnetic noise level in the mine was low enough (approximately $3 \times 10^{-8}$ A/m $\sqrt{\text{Hz}}$) that it is conservatively estimated that the receiver would have detected the signal to a depth of at least 300 m all else being constant.

The present invention, which was conceived and developed at the Laramie Energy Technology Center of the U.S. Dept. of Energy, Laramie, Wyo., provides many advantages, including: easy placement, small size, simple operation, and low cost. The flexibility of the system allows the number of subsurface units to vary depending on problems or successes in blasting. Extensive mining is not needed if it is decided to increase the number of tracer gas release levels.

While an example of the method of the invention has been shown and described, further examples of the invention will be apparent to those skilled in the art without departing from the spirit of the invention. For example, the sequence of activation of the emplanted tracer gas units may be varied as appropriate to existing conditions and data desired.

What is claimed is:

1. A method for characterizing an in situ oil shale retort prior to ignition of the retort, wherein said retort is formed by mining a void having a floor in an oil shale deposit, and then sequentially blasting a plurality of layers of rock rubble into said void, each of said layers having an upper level, a roof being formed in said retort by the last sequence of the blasting, said retort being provided with a plurality of access holes from the surface of the earth to said roof, and an outlet at the floor of said retort, including the steps of:

emplacing a plurality of units containing tracer gas at the upper level of each layer of rubble prior to blasting to form the next layer, each of said units including electromagnetic (EM) signal receiving means that is responsive to a coded EM signal to release said tracer gas into the rubble;

transmitting coded EM signals to said receiving means to selectively release gas from said units;

forcing said released gas to flow to said outlet; and monitoring the time of arrival of said released gas at said outlet for characterization of said retort.

2. The method of claim 1, werein said units are emplaced through said access holes.

3. The method of claim 1, wherein said units are buried in gravel after emplacement.

4. The System of claim 1, wherein said receiving means includes a preamplifier and a hard-limited output amplifier.

5. The method of claim 1, wherein said coded EM signals may be in the range of very low frequency (VLF) signals (3,000–30,000 Hz) down to and including voice frequency (VF) signals (300–3,000 Hz).

6. The method of claim 5, wherein said EM signals are signals between 300 Hz and 6,000 Hz.

7. The method of claim 6, wherein said EM signals are frequency shift keyed between 3,030 and 3,150 Hz.

8. The method of claim 5, wherein said signals are frequency shift keyed.

9. The method of claim 1, wherein each of said tracer gas units on any one level of rubble contains a different tracer gas.

10. The method of claim 9, wherein each of said tracer gas units is responsive only to a respective one of said coded EM signals to release tracer gas.

11. The method of claim 10, wherein said units on any one level of rubble are individually, successively and sequentially activated to release tracer gas.

12. The method of claim 11, wherein said units in the topmost portion of the retort are activated first and then units in successive lower portions are activated in sequence.

13. The method of claim 11, wherein said units in the bottommost portion of the retort are activated first and then units in successive higher portions are activated in sequence.

14. The method of claim 1, further including the step of injecting tracer gas down each of said access holes and monitoring the time of arrival of the access hole gas at said outlet for further characterization of said retort.

15. A system for characterizing an in situ oil retort prior to ignition of the retort, wherein said retort is formed by mining a void having a floor in an oil shale deposit, and then sequentially blasting a plurality of layers of rock rubble into said void, each of said layers having an upper level, a roof being formed in said retort by the last sequence of the blasting, with a plurality of access holes from the surface of the earth to said roof, and an outlet at the floor of said retort, including:

a plurality of units containing tracer gas for emplacement at the upper level of each layer of rubble prior to blasting to form the next layer, each of said units including EM receiving means that is responsive to a coded EM signal to release said tracer gas into the rubble;

means for transmitting coded EM signals to said receiving means to selectively release said tracer gas from said units;

means for forcing said released gas to flow to said outlet; and means for monitoring the time of arrival of said released gas at said outlet for characterization of said retort.

16. The system of claim 15, wherein said transmitting means includes a loop antenna positioned on the surface of the earth above said retort.

17. The system of claim 15, wherein said transmitting means includes apparatus for frequency shift keying said EM signals to encode said signals.

* * * * *